US007192179B2

(12) United States Patent
Angeletta

(10) Patent No.: US 7,192,179 B2
(45) Date of Patent: Mar. 20, 2007

(54) DUAL MIXING SYSTEM FOR LIQUID AND LOTION APPLICATORS

(76) Inventor: Joseph G. Angeletta, 418 Fifth St., Mamaroneck, NY (US) 11530

( * ) Notice: Subject to any disclaimer, the term of this patent is extended or adjusted under 35 U.S.C. 154(b) by 116 days.

(21) Appl. No.: 10/888,380

(22) Filed: Jul. 8, 2004

(65) Prior Publication Data

US 2005/0007871 A1 Jan. 13, 2005

Related U.S. Application Data

(60) Provisional application No. 60/485,534, filed on Jul. 8, 2003.

(51) Int. Cl.
*B65D 25/08* (2006.01)

(52) U.S. Cl. ..... 366/130; 206/222

(58) Field of Classification Search ..... 366/130, 366/189, 348, 349; 206/219, 222; 215/DIG. 8; 222/142.1, 145.5; 604/220; D28/7
See application file for complete search history.

(56) References Cited

U.S. PATENT DOCUMENTS 3,548,562 A * 12/1970 Schwartzman ..... 206/222
3,687,076 A * 8/1972 Friant et al. ..... 206/222
4,103,772 A * 8/1978 Wiegner ..... 206/222
4,174,035 A * 11/1979 Wiegner ..... 206/222
4,193,698 A * 3/1980 Gartner ..... 366/130
4,208,133 A * 6/1980 Korte-Jungermann ..... 366/130
4,676,655 A * 6/1987 Handler ..... 366/130
4,941,520 A * 7/1990 Dowzall et al. ..... 366/130
5,286,258 A * 2/1994 Haber et al. ..... 206/219
5,588,745 A * 12/1996 Tanaka et al. ..... 366/130
6,612,465 B2 * 9/2003 Pierson et al. ..... 222/145.5
2005/0007871 A1 * 1/2005 Angeletta ..... 366/130

FOREIGN PATENT DOCUMENTS

DE 3208993 A1 * 9/1983

* cited by examiner

*Primary Examiner*—Charles E. Cooley
(74) *Attorney, Agent, or Firm*—Scully, Scott, Murphy & Presser, P.C.

(57) ABSTRACT

A system for mixing two or liquid components for dispensing from a common receptacle. An end member applies pressure to containers containing different liquids or lotions. The containers are housed in the common receptacle. Piercing elements at a dispensing end within the receptacle puncture frangible ends of the containers causing the liquid components to enter the common receptacle and mix prior to eventual dispensing from the receptacle. Various nozzles, valves or tips are used to dispense the mixed components as desired.

15 Claims, 16 Drawing Sheets

4) SHAKE
5) REMOVE COVER & APPLY PRODUCT

SPRING VALVE APPLICATOR

SQUIRT PLUG APPLICATOR

DUAL MIXING SYSTEM FOR LIQUID AND LOTION APPLICATORS

CROSS REFERENCE TO RELATED APPLICATIONS

This application claims the benefit of prior U.S. Provisional Application No. 60/485,534 filed Jul. 8, 2003.

BACKGROUND OF THE INVENTION

1. Field of the Invention

The present invention relates to a dual mixing system for liquid and lotion applicators, and in particular pertains to a dispensing apparatus whereby separately stored constituents of a liquid or lotion are adapted to be premixed prior to the dispensing thereof.

2. Prior Art

In various instances liquid and lotion applicators may incorporate sponge-type applicators, brush like applicators or even nozzle orifices adapted to store quantities of a particular liquid or lotion or a combination thereof, such as may be body lotions, different types of semi-liquid creams or gels, or a liquid or gel which may be used for various commercial and industrial purposes. The various liquids, lotions, creams or gels may be stored for considerable periods of time prior to their use.

At times these liquids, lotions, creams or gels are comprised of two or more components which, when stored in a mixed manner, may separate or change properties over time. It is therefore advantageous that these particular components be sealingly stored in separate containments.

Although it is possible to pour and mix the various components, such as two or more liquids or lotions, into a dispensing container them prior to attaching an applicator to the dispensing container and implementing the use thereof the mixture, this entails the storage of separate component containers, which can complicate the admixing process. Locating the various separate containers can increase the time and steps necessary to achieve the desired mixture as well. Moreover, such separately stored components, when poured into a single dispensing container, may not be admixed in the appropriate relative quantities, thereby compromising the consistency and/or other properties the liquid or lotion component mixture was intended to provide.

SUMMARY OF THE INVENTION

In order to obviate the limitations encountered in the prior art, the present invention provides a dual mixing system for liquid and lotion applicators that is stored within the housing of an applicator. In particular, each of the liquid or lotion components may be contained in a separately sealed container located in a receptacle. The receptacle is adapted to form a dispenser or applicator for the mixed product. Piercing elements may be provided which, upon the depression of an element, cause frangible ends of the separate containers to be perforated, enabling the liquid or lotion components to flow out therefrom. Upon suitable shaking of the receptacle the liquid or lotion components are admixed prior to being dispensed or applied as desired.

Accordingly, the present invention provides for various embodiments of a dual mixing system for liquid and lotion applicators as described and illustrated hereinbelow in order to enable the desired mixture of liquid and lotion components to occur prior to being dispensed or applied. According to the various embodiments described herein, the invention comprsises at least a receptacle having a body portion of an oblong shape of either cylindrical or oval configuration in cross-section. A dispensing end of a tapered conical configuration terminates in a threaded end to which a tapered nozzle may be attached. A tip of the nozzle may be a separable element that is threaded secured to the nozzle, as shown in FIG. 6 of the drawings, and which upon unscrewing, enables the opening of an orifice to dispense the liquid or lotion contained in the receptacle.

BRIEF DESCRIPTION OF THE DRAWINGS

These and other features, aspects and advantages of the systems and methods of the inventin will become better understood with regard to the following description, drawings, and appended claims, wherein:

DETAILED DESCRIPTION OF THE INVENTION

Figure 1:
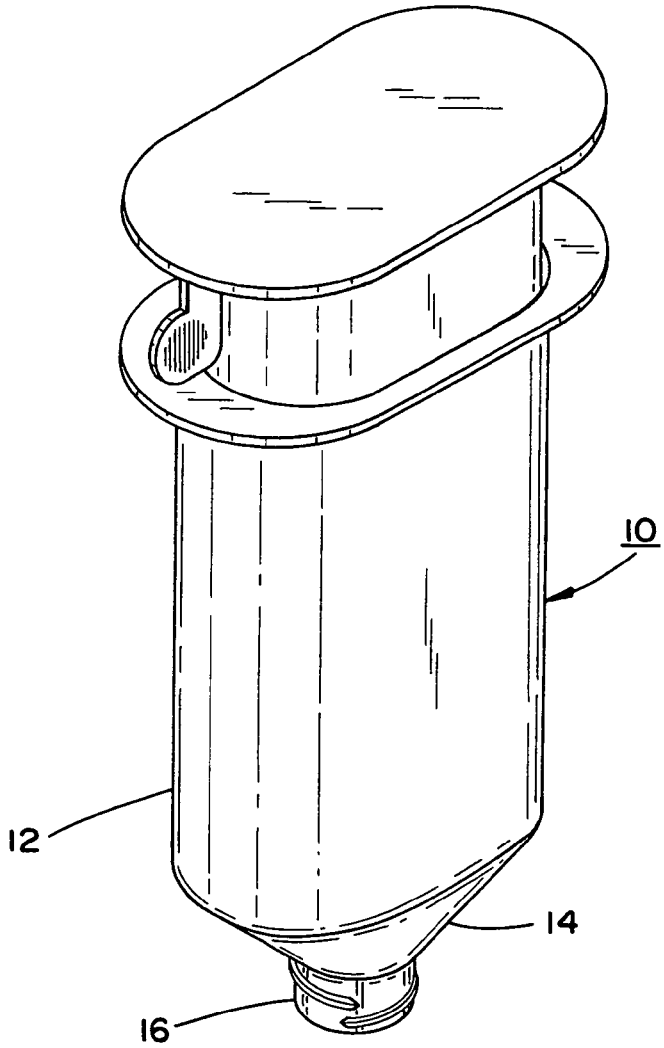
FIG. 1 illustrates a perspective view of the outer casing of an exemplary receptacle according to the invention.

FIG. 1 illustrates a perspective view of the outer casing of a receptacle 10 according to one aspect of the invention. The receptacle 10 has a body 12 having an oblong shape of either a cylindrical or oval configuration in cross-section. A dispensing end 14 having a tapered conical configuration terminates in a threaded end 16. The body 12 extends to an open end opposite the dispensing end 14.

Figure 2:
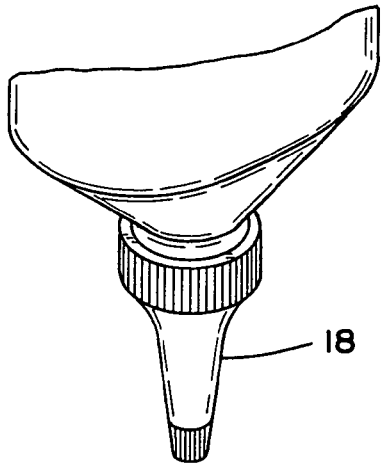
FIG. 2 illustrates a nozzle and tip for associating with the receptacle of FIG. 1 according to the invention.
Figure 3:
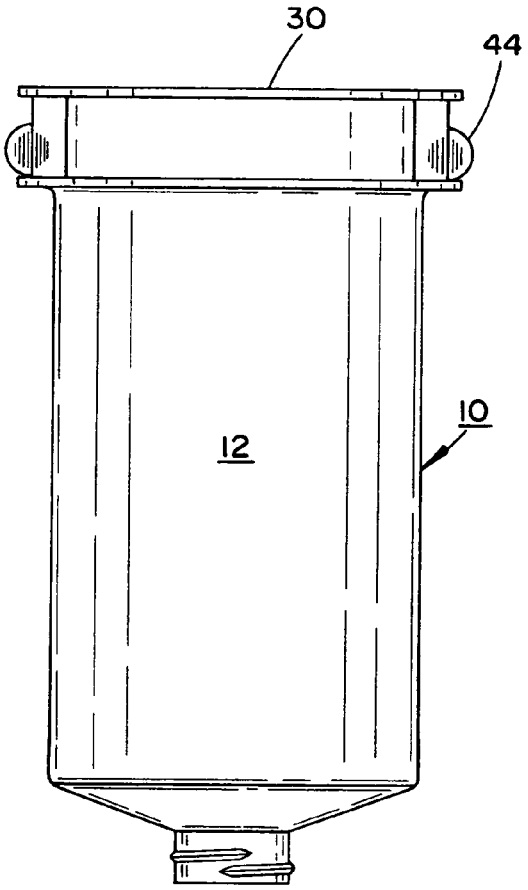
FIG. 3 illustrates a front view of the receptacle of FIG. 1 according to the invention.
Figure 6:
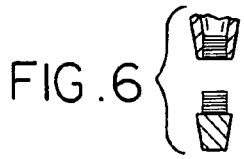
FIG. 6 illustrates the tip disengaged from the nozzle of FIGS. 2, 4 and 5 according to the invention.

FIG. 2 shows a tapered nozzle 18 that attaches to the threaded end 16 of the receptacle 10. A tip 20 of the nozzle 18 may be provided, as shown in FIG. 6. Where provided, the tip 20 may be a separable element that is threadedly secured to the nozzle 18 by screwing the tip 20 thereto. Upon unscrewing the tip 20 from the nozzle 18 an orifice in the nozzle is exposed enabling liquids or lotions contained in the receptacle 10 to be dispensed therefrom.

As shown more particularly in FIGS. 3 through 6, the interior of the receptacle body 12 may contain two closed or sealed containers 24 and 26. The sealed containers 24 and 26 are inter-engaged by means of, respectively, a recess and cooperating protuberance 28. The artisan will appreciate that the recess and protuberance 28 may be provided on either of the containers to inter-engage the containers appropriately. The containers 24 and 26 are further secured to a plunger or depressable end member 30 within the receptacle 10.

The end member 30 shown in FIGS. 3-6, for example, has a flat bottom end plate 36 and cylindrical body side walls 38 extending therefrom. The side walls 38 slide into the receptacle 10 and maintain a closely sealed relationship within the open end of the body 12 of the receptacle 10. A groove 32 provided on each of the containers 24 and 26 engages a projection 34 provided on the interior surface of the side walls 38 of the end member 30. A radially projectable flange 37 extends beyond the side walls 38 at the closed end of the end member 30.

As shown in FIGS. 3–6, the open end of the body 12 has a radially extending flange 40 which is normally in a spaced relationship from the end plate 36, and is retained in that manner by means of a circular band 42 and outstanding tab portions 44, as explained hereinafter below.

Referring still to FIGS. 3–6, the dispensing end 14 of the receptacle body 12 includes the downwardly tapered portion 48 and two piercing elements 50 and 52. The piercing elements 50 and 52 project within the receptacle from the tapered portions 48 towards flangible closures 54 and 56 located at ends of the closed containers 24 and 26 respectively.

Figure 5:
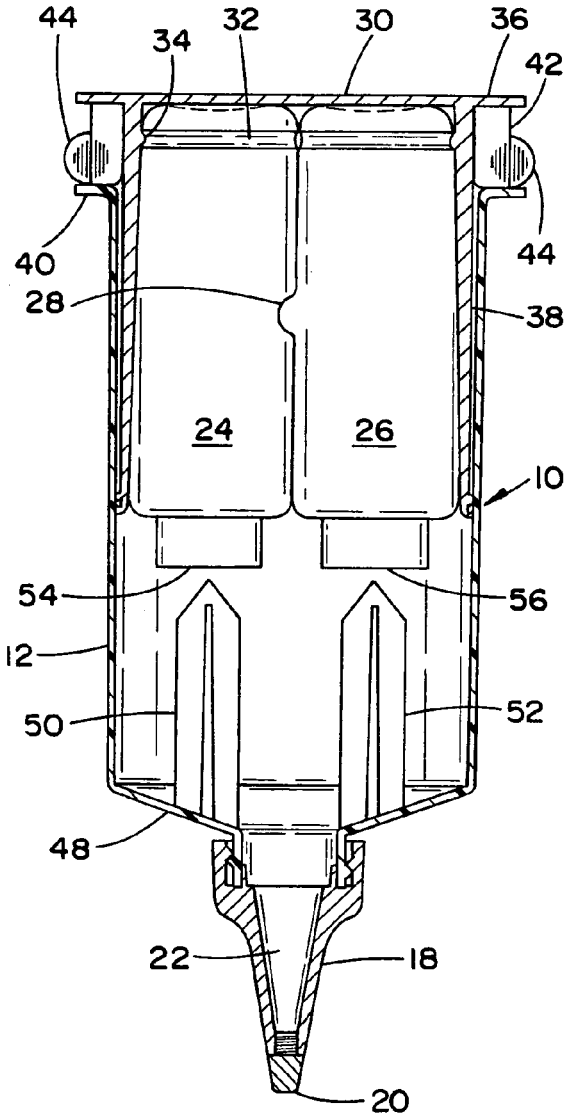
FIG. 5 illustrates a cut-away view of the interior components of the receptacle and nozzle of FIGS. 1–4 according to the invention.
Figure 4:
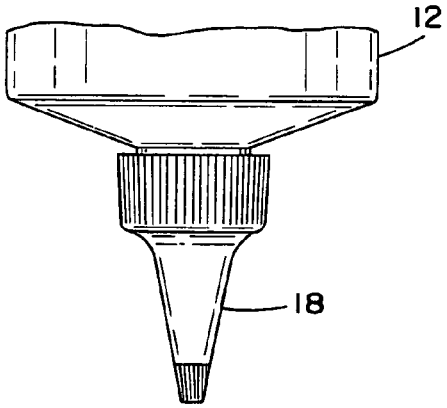
FIG. 4 illustrates another view of the nozzle of FIG. 2 for associating with the receptacle of FIGS. 1 and 3 according to the invention.
Figure 7:
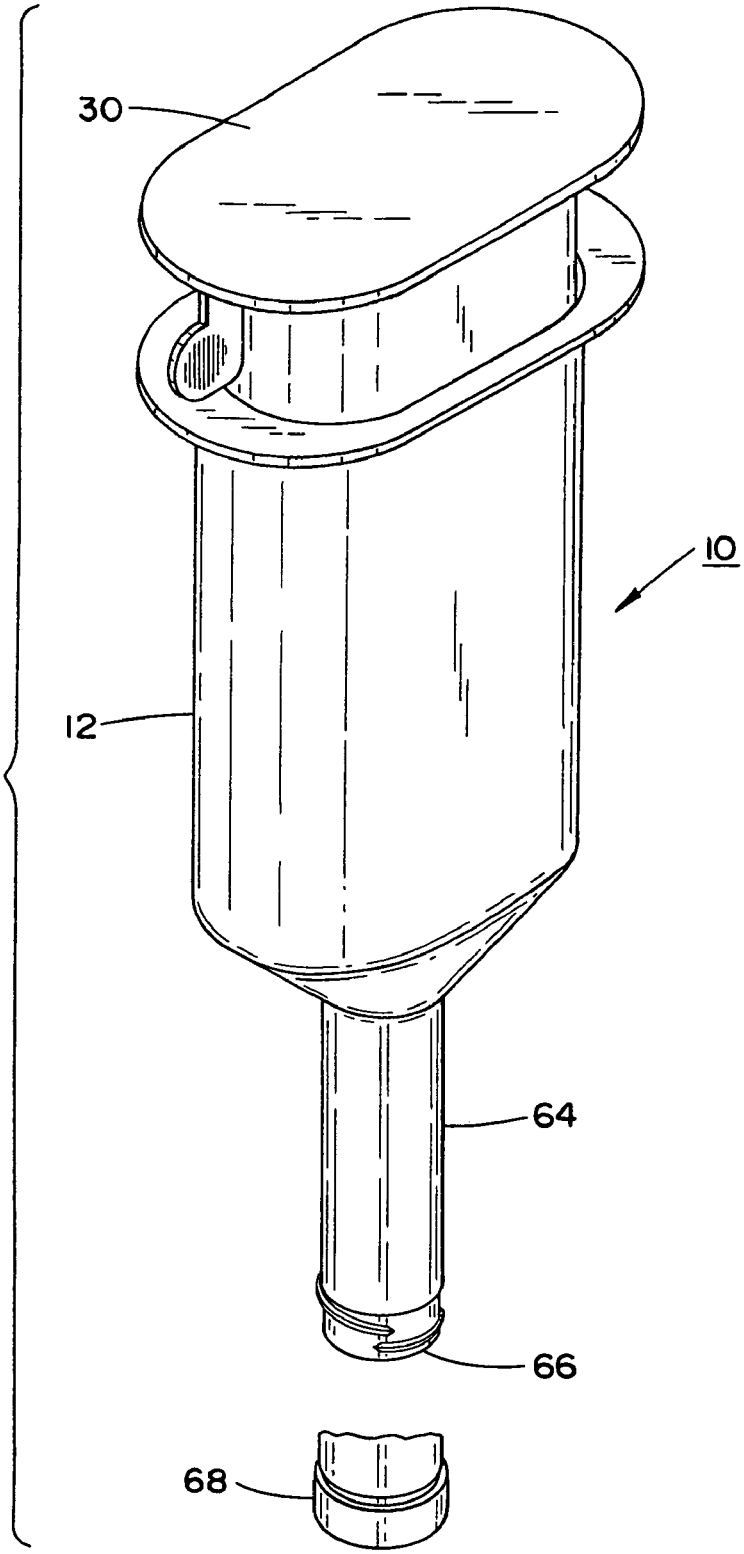
FIG. 7 illustrates a perspective view of another embodiment of a receptacle according to the invention.
Figure 11:
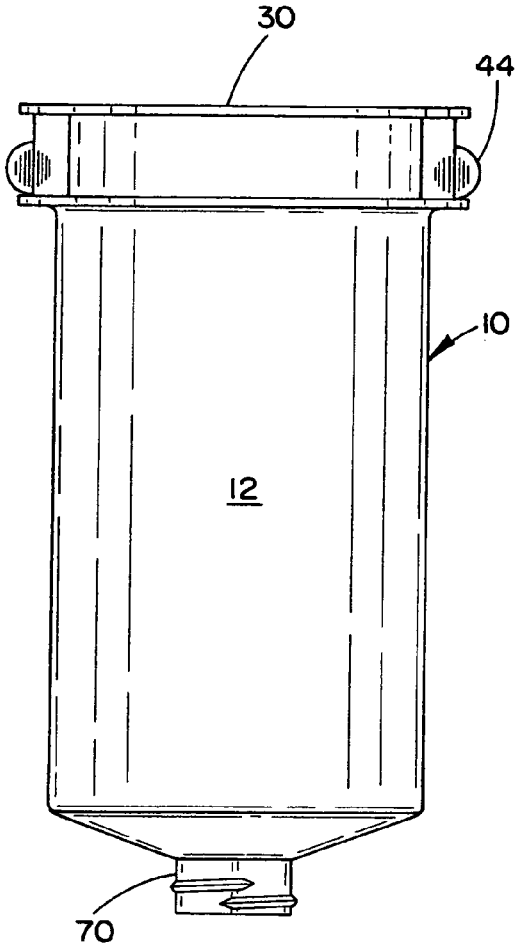
FIG. 11 illustrates a front view of the receptacle of FIGS. 9 and 10 according to the invention.
Figure 8:
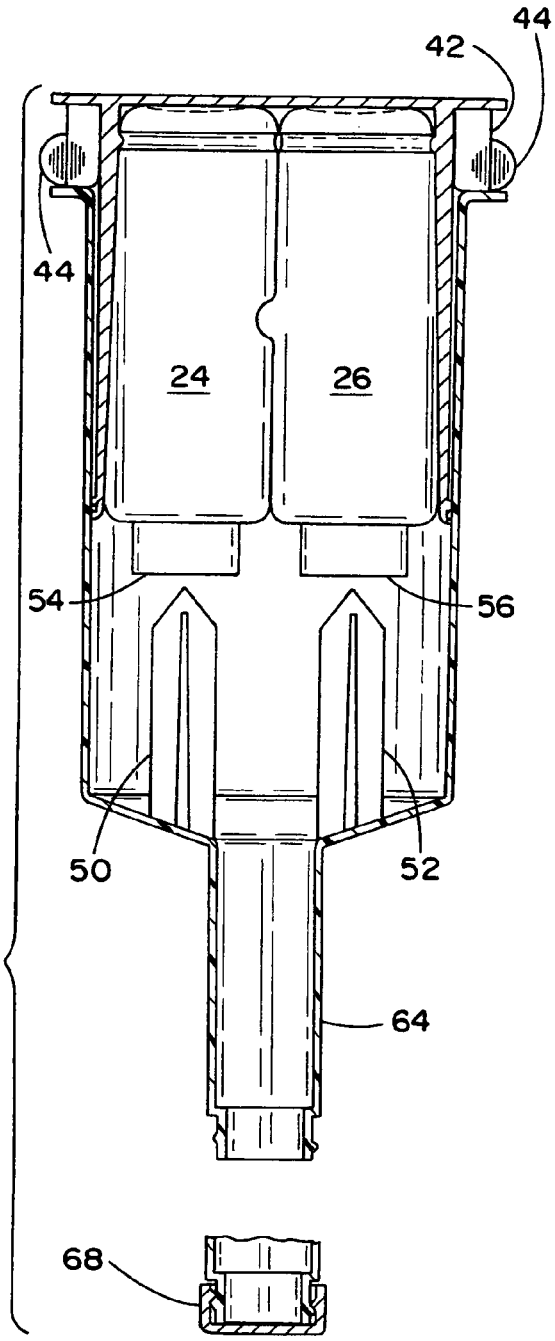
FIG. 8 illustrates a cut-away view of the interior components of the receptacle of FIG. 7.
Figure 9:
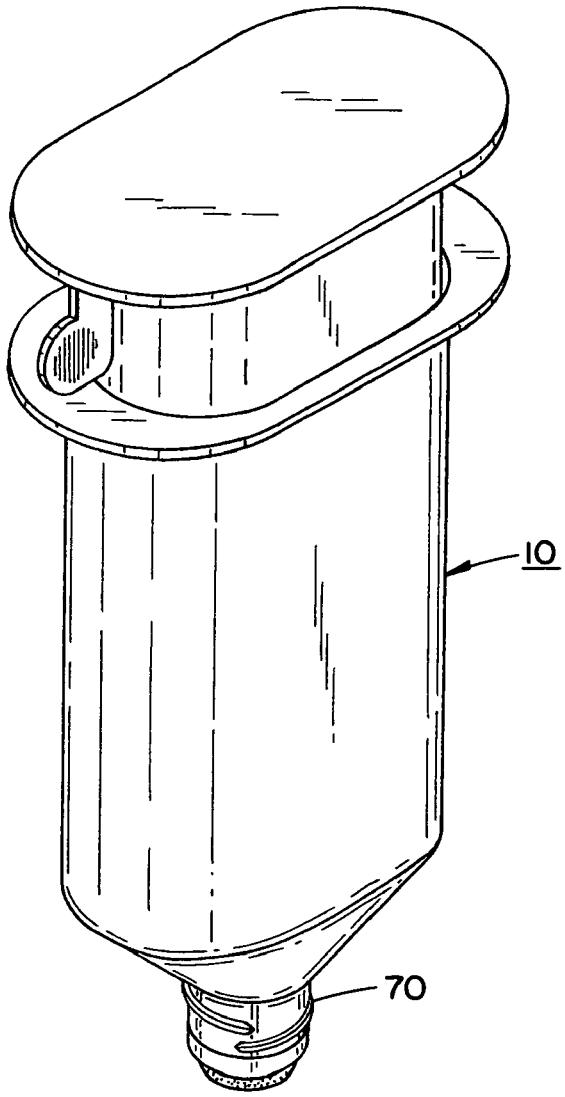
FIG. 9 illustrates a perspective view of another embodiment of a receptacle according to the invention.
Figure 10:
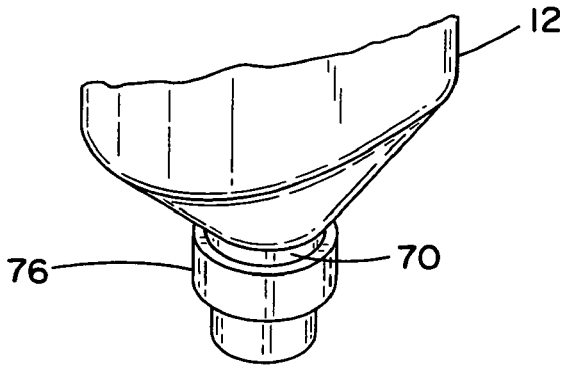
FIG. 10 illustrates a dispensing end and cap for associating with the receptacle of FIG. 9 according to the invention.
Figure 12:
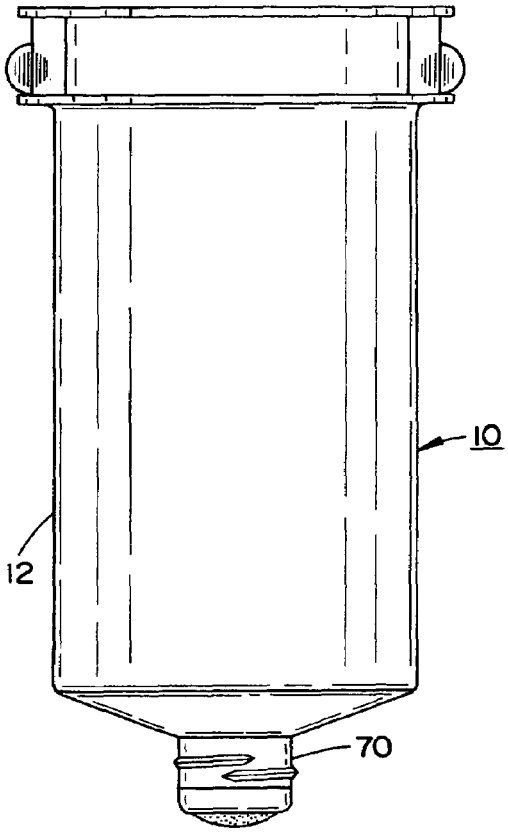
FIG. 12 illustrates a front view of the receptacle of FIG. 11 with a dispensing valve according to the invention.
Figure 14:
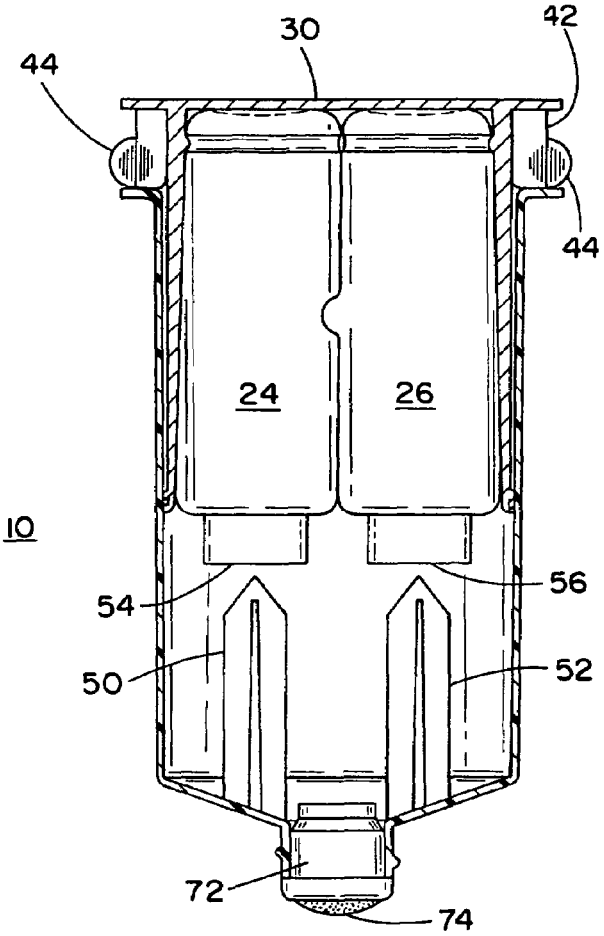
FIG. 14 illustrates a cut-away view of the interior components of the receptacle and valve of FIGS. 9–13 according to the invention.
Figure 13:
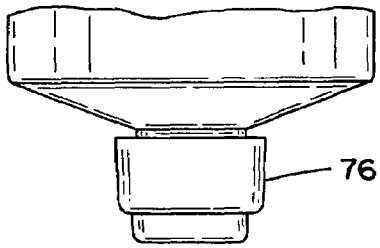
FIG. 13 illustrates a cap configuration for associating with the receptacle of FIG. 12 according to the invention.
Figure 15:
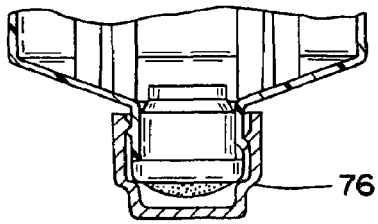
FIG. 15 illustrates a cut-away view of a cap over the valve at a dispensing end of the receptacle of FIG. 14 according to the invention.

FIGS. 7 and 8 illustrate another embodiment of the dual mixing system according to the invention wherein similar parts are identified by the same reference numerals as in the preceding embodiment described with reference to FIGS. 1–6. The primary distinction between the embodiment of FIGS. 1–6 versus the embodiment of FIGS. 7 and 8 resides in an elongated neck portion 64 provided in FIGS. 7 and 8. The elongated neck portion 64 has a threaded orifice 66 adapted to be closed by means of a threaded cap member 68. For the remainder, all of the internal components are identical to those as shown in FIG. 5.

Referring to FIGS. 9 through 15, in which similar elements of earlier embodiments are identified using similar reference numerals, another embodiment of the dual mixing system according to the invention is described. As shown in FIGS. 9–15, the dispensing end of the receptacle 10 extending from the body 12 has a slightly lengthier threaded neck 70 as compared with earlier embodiments. The lengthier threaded neck 70 is adapted to receive a valve 72 through which the liquid and lotion mixture provided in the receptacles is dispensed. A sponge like applicator 74 connects to an exposed outer end of the valve 72, with the valve being mounted in the neck portion 70. The valve 72 is adapted to be normally closed by means of a closure cover or cap 76 that threads onto the neck portion 70. Other components of the embodiment described with reference to FIGS. 9–15 are generally the same as described with reference to FIGS. 5 and 14, unless otherwise noted herein.

Figure 16:
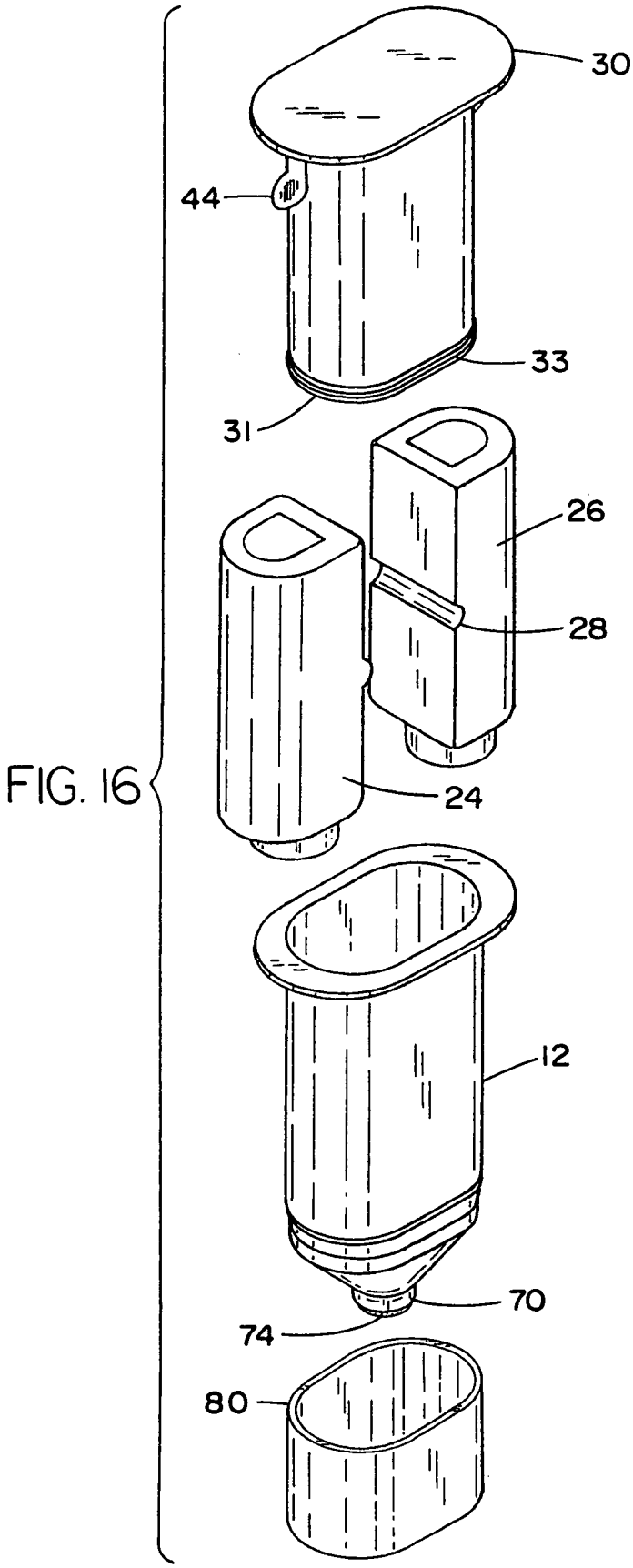
FIG. 16 generically illustrates an exploded perspective view of a receptacle, interior containers and a depressing end member according to the invention.

Referring to FIG. 16, which generically illustrates some of the interior components of the dual mixing system according to the invention, the body 12 of the receptacle 10 is shown to receive two sealed containers 24 and 26. Each container 24 and 26 is understood to contain one of the liquid or lotion components to be mixed with one another and dispensed. The two containers 24 and 26 are to be retained in position relative to each other by means of the complementary groove and projection 28 therebetween, as described earlier with respect to the embodiment shown in FIG. 2.

Referring still to FIG. 16, extending over the containers 24 and 26 is the plunger or depressable end member 30 having the end plate 36 adjacent the bottom of the containers. Breakaway tabs 44 attached to a ring 42 on an outer surface of the sidewalls 38 of the end member 30 preclude the end plate 36 from moving until the tabs 44 are broken and removed from the end member 30 as described in further detail below with reference to FIGS. 17–19. The entry end of the plunger or end member 30 may be equipped with one or a pair of O-rings 33 to provide for sealing when inserted into the body 12. At the dispensing end 70 of the body 12, shown in FIG. 16 to have the sponge like applicator 74 thereon, a larger cover 80 rather than the screw cap 76 may instead be provided.

Figure 17:
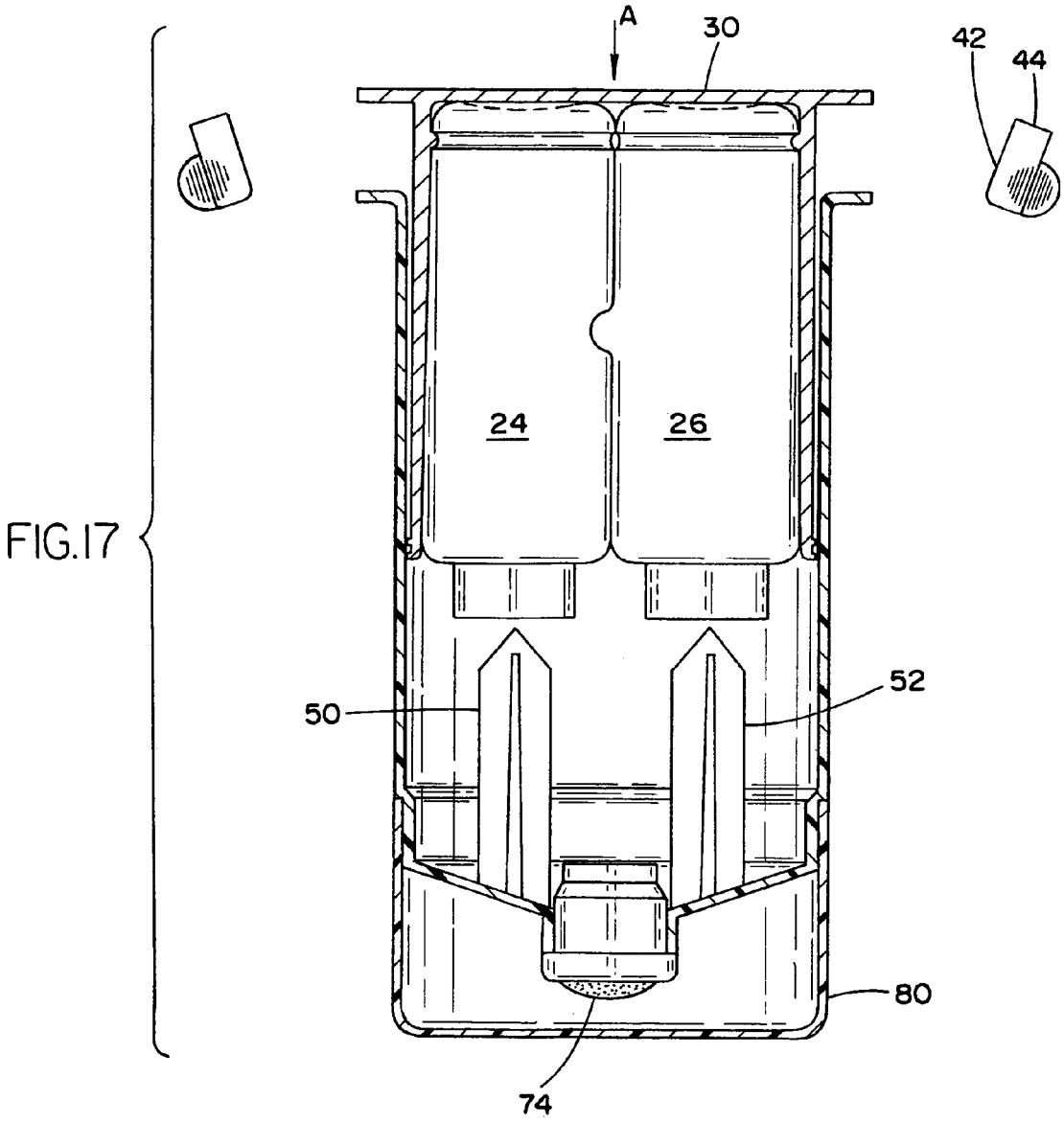
FIGS. 17–22 illustrate a method of operation of the dual mixing system according to the invention.
Figure 18:
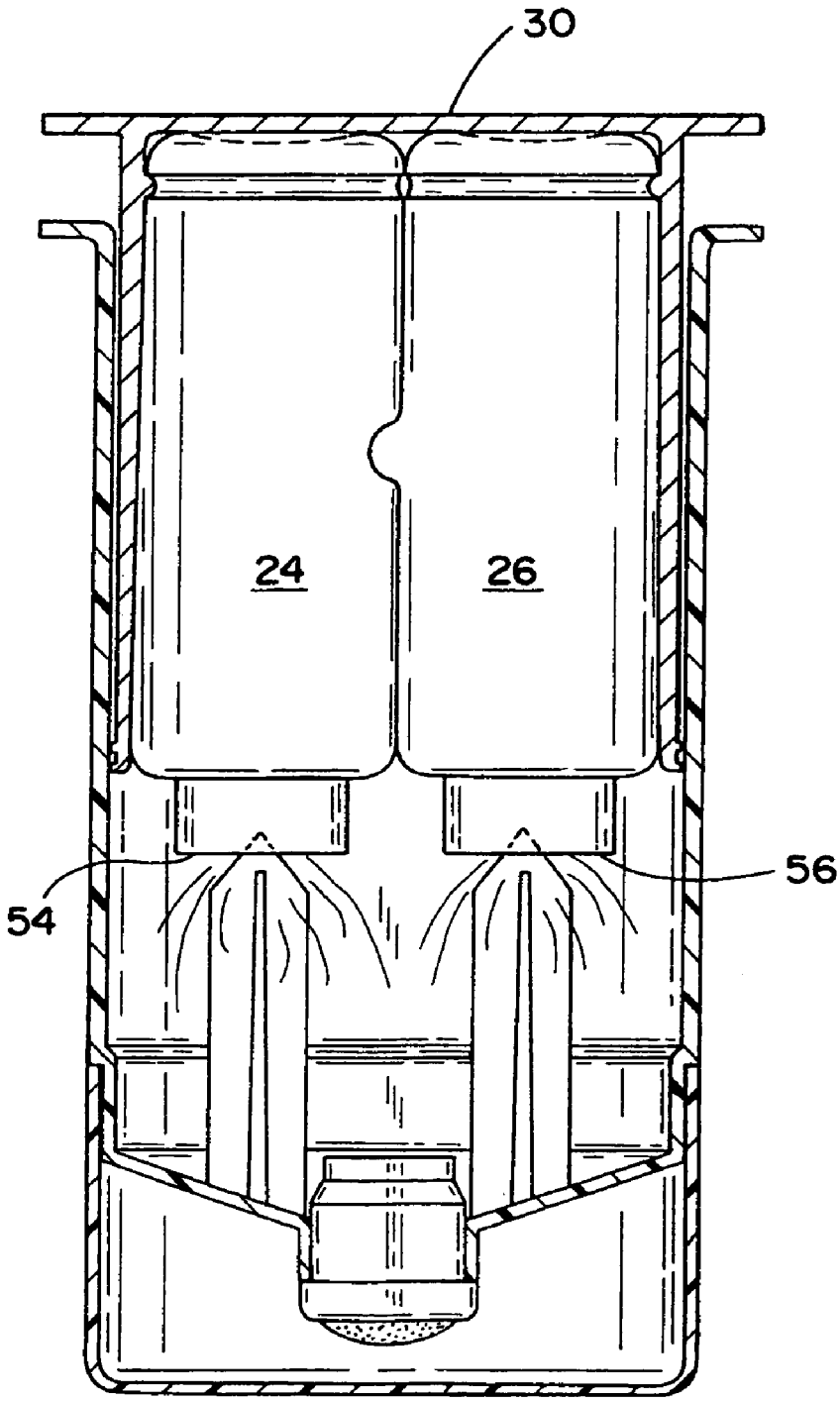
Figure 19:
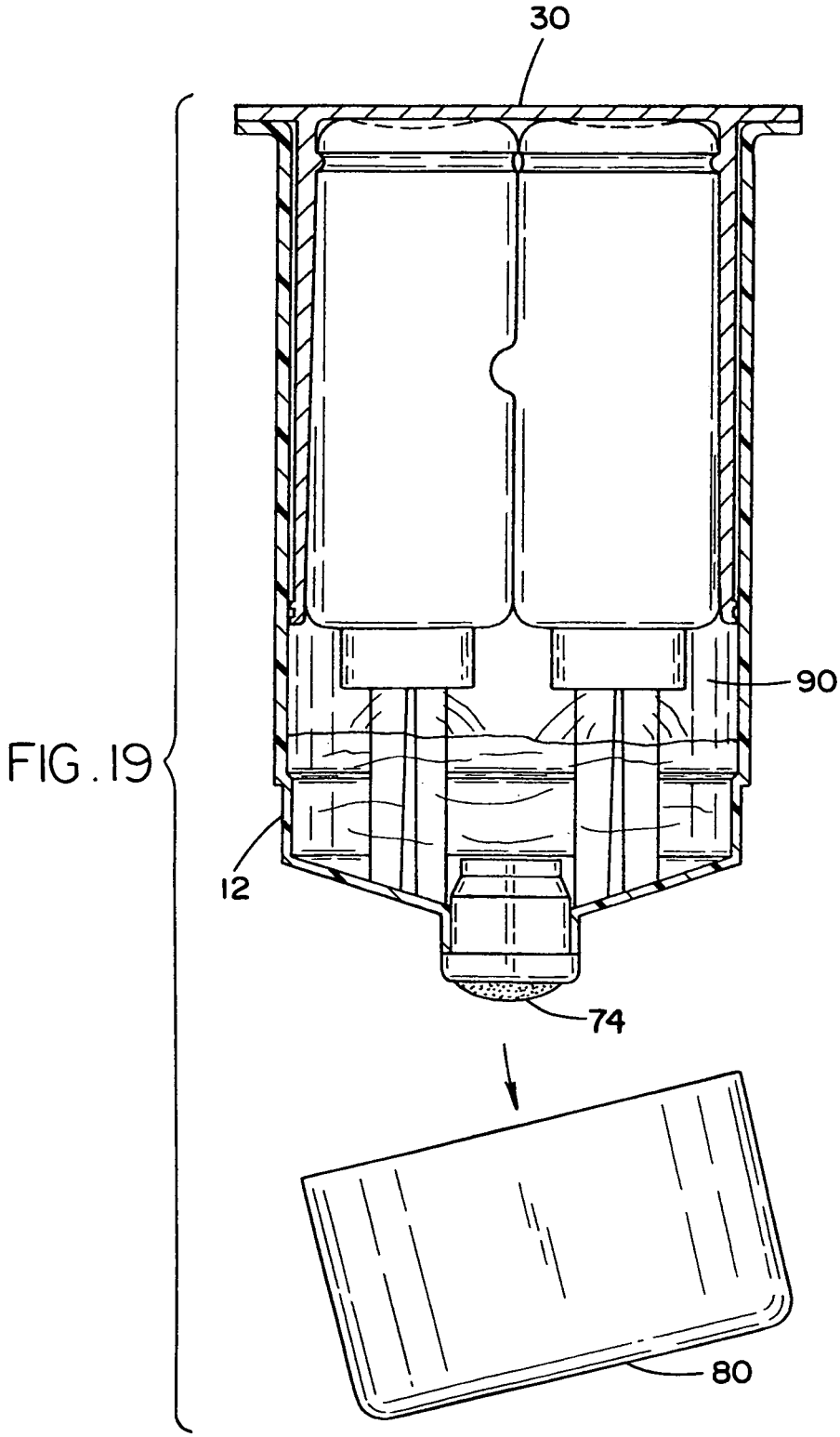

FIGS. 17 through 19 illustrate the operation of the dual mixing system according to the invention, whereby the tabs 44 are removed from the outer surface of the sidewalls 38 of the end member 30 to enable the end plate 36 of the bottom depressing member to be pushed downwardly against the containers 24 and 26 in the direction of arrow A. The downward push of the endplate 36 against the containers 24 and 26 cause the piercing members 50 and 52 to rupture and penetrate the frangible openings 54 and 56 at ends of the respective containers 24 and 26. As a result, the liquids or lotions contained in the respective containers leave the containers and enter the space 90 within the body 12 of the receptacle 10. Upon shaking, these liquid and lotion components are admixed prior to reaching the dispensing sponge member 74, as shown by way of example in FIGS. 17–19. Pulling off the cover member 80 provides access to the sponge 74 which has ideally now been saturated or supplied with the admixed liquids. Of course, although the description with reference to FIGS. 17–19 is shown with reference to the sponge like applicator of FIGS. 9–15, the artisan will readily appreciate that the other described embodiments operate in similar fashion wherein the dispensing means may be the nozzle and tip of FIGS. 1–6, the elongated neck of FIGS. 7–8, or other known or later developed dispensing means suitable to the receptacles described herein.

Figure 20:
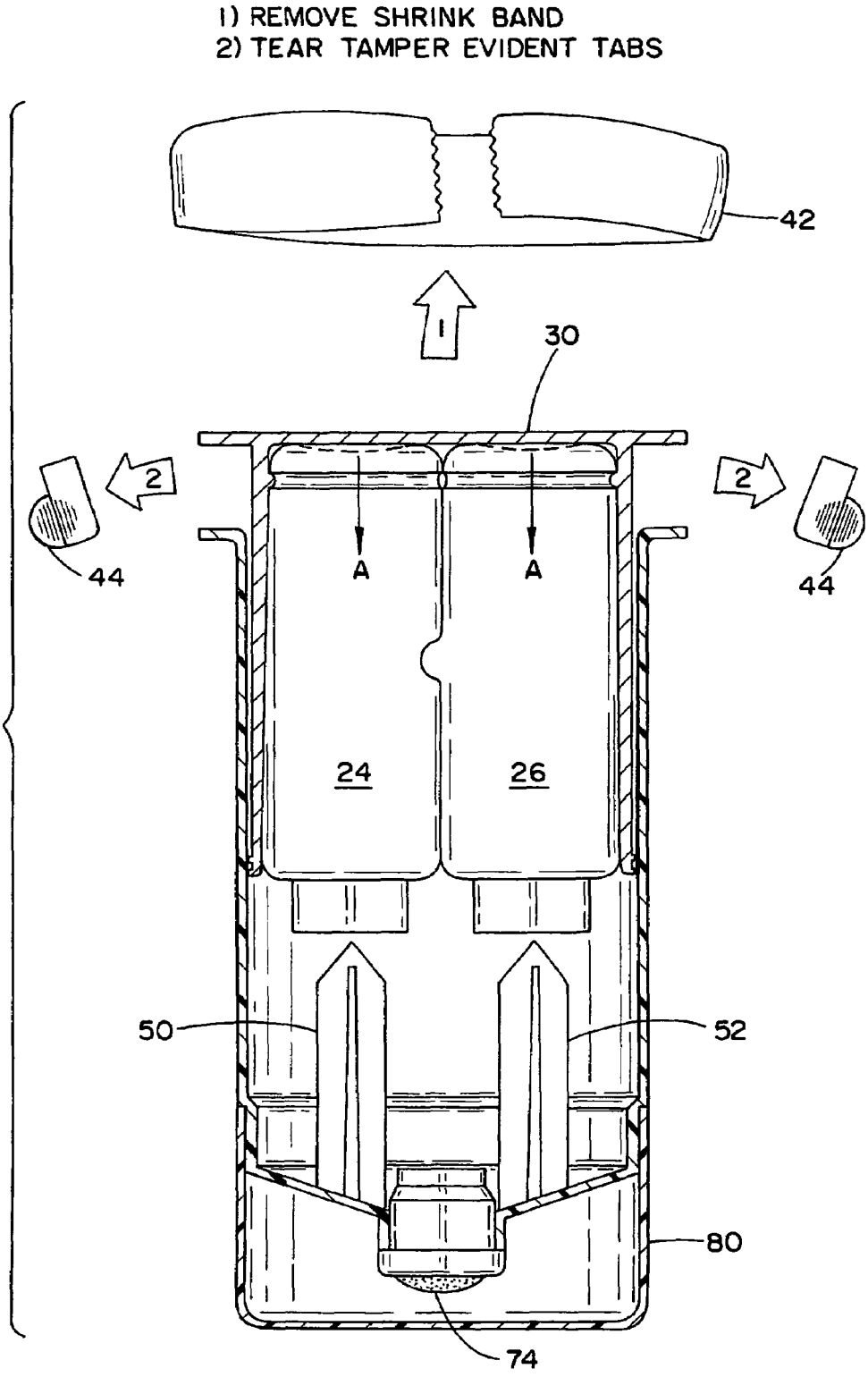
Figure 21:
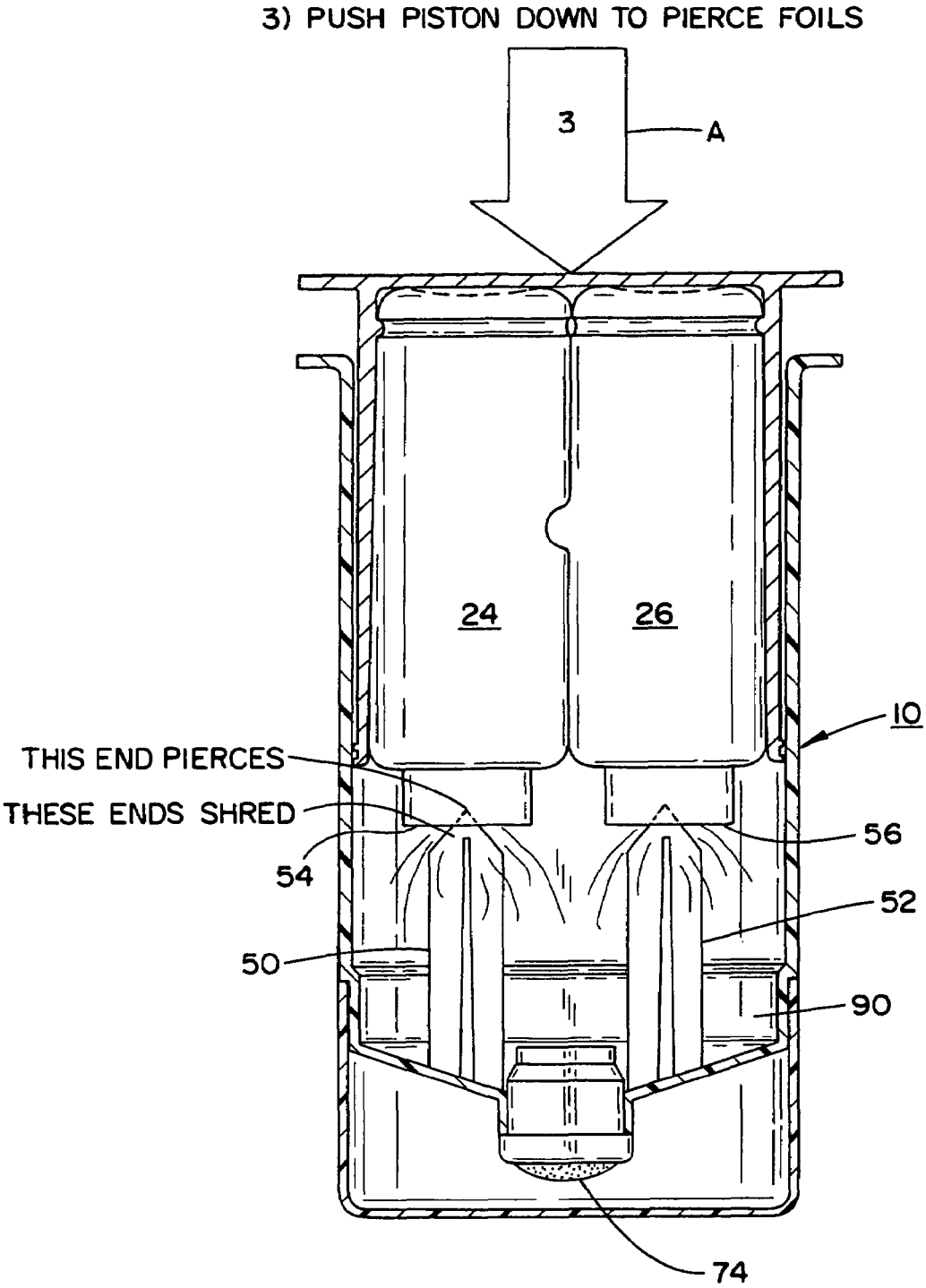
Figure 22:
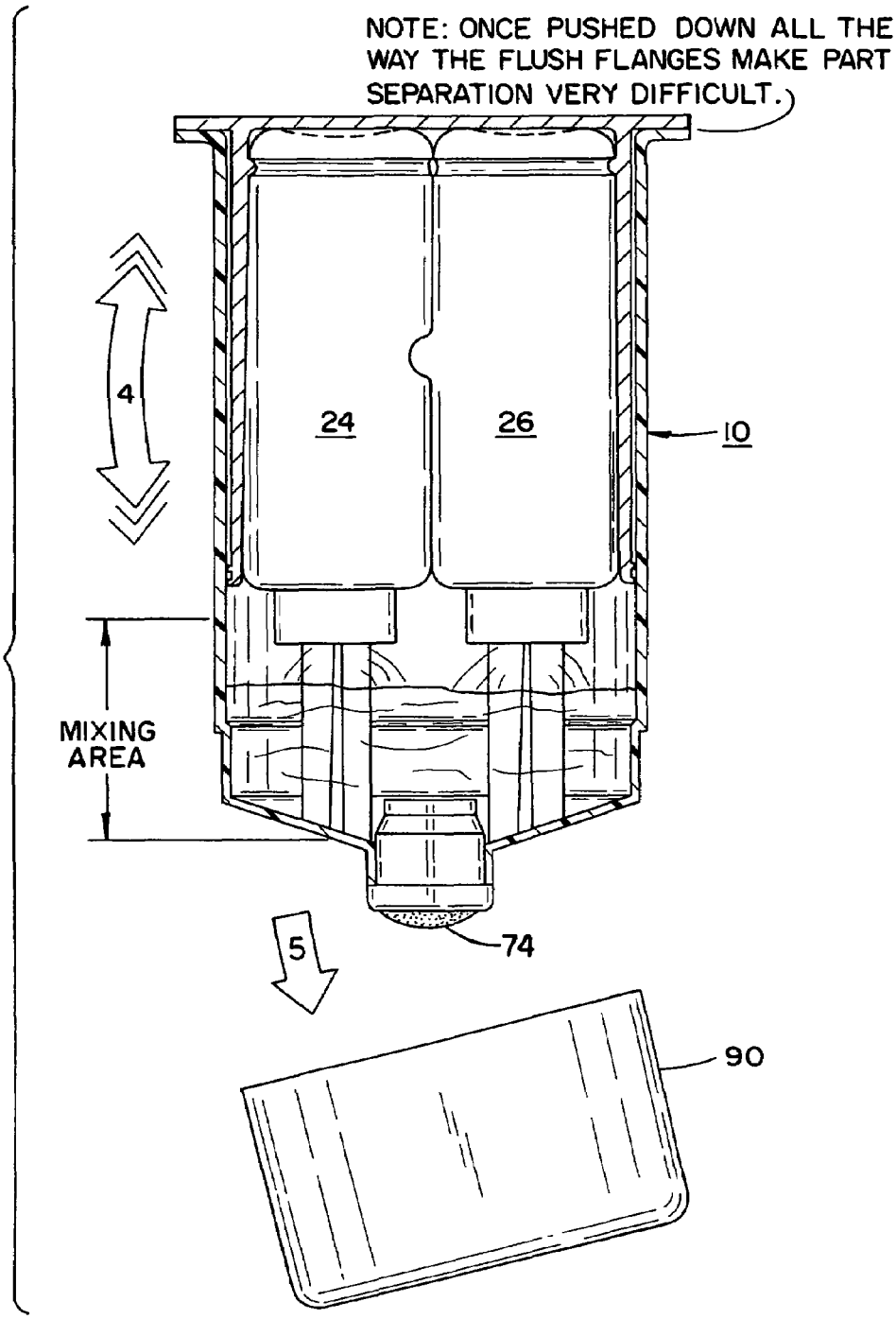
Figure 23:
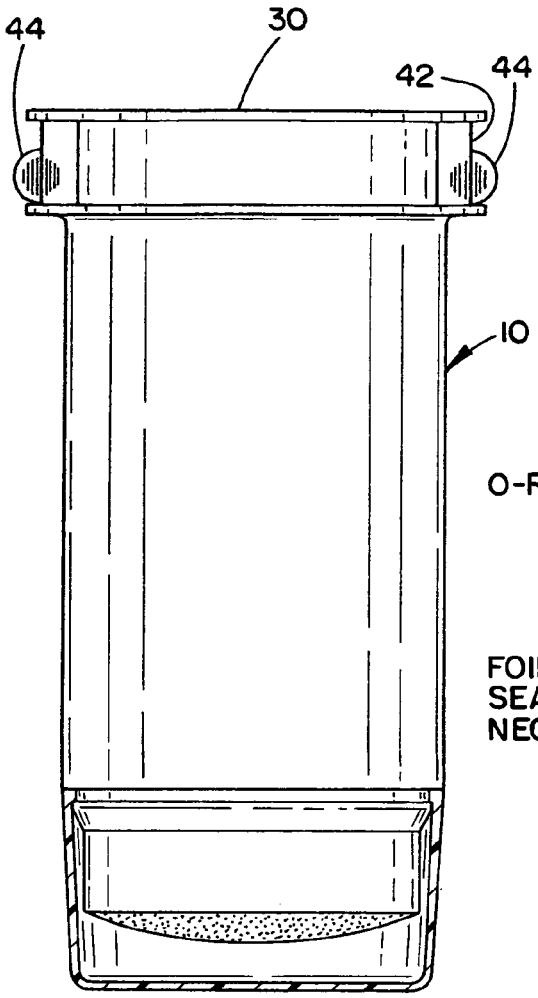
FIGS. 23–28 illustrate another embodiment of the dual mixing system according to the invention.
Figure 28:
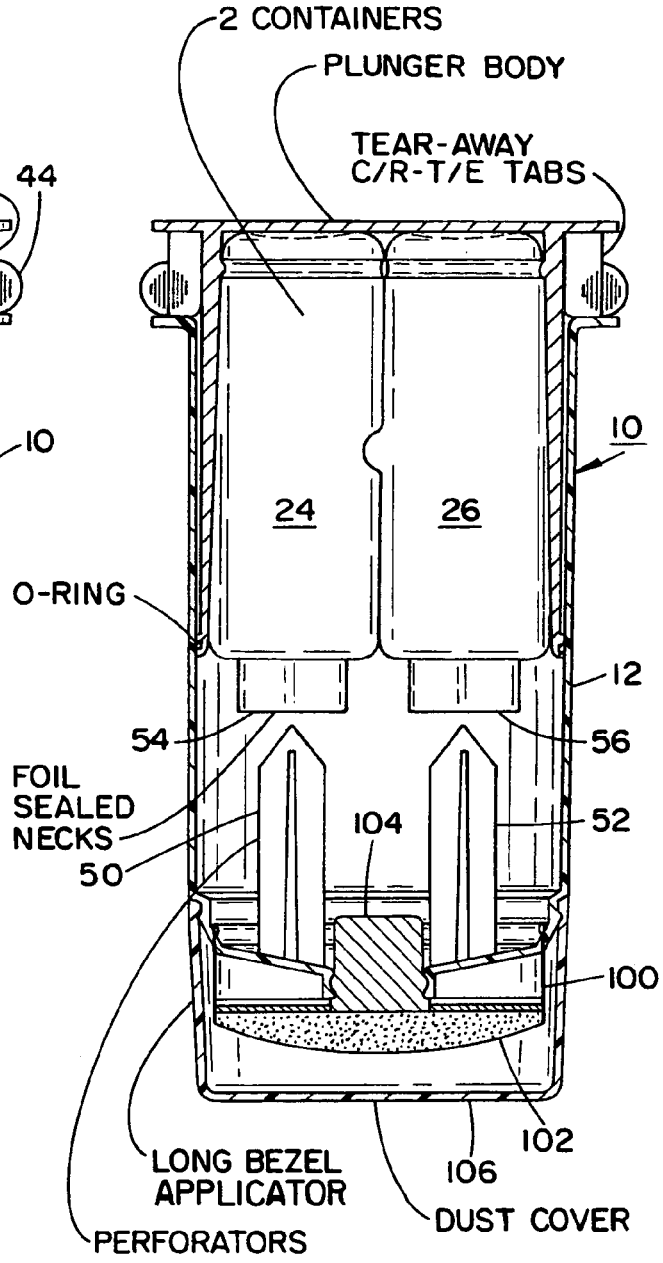
Figure 24:
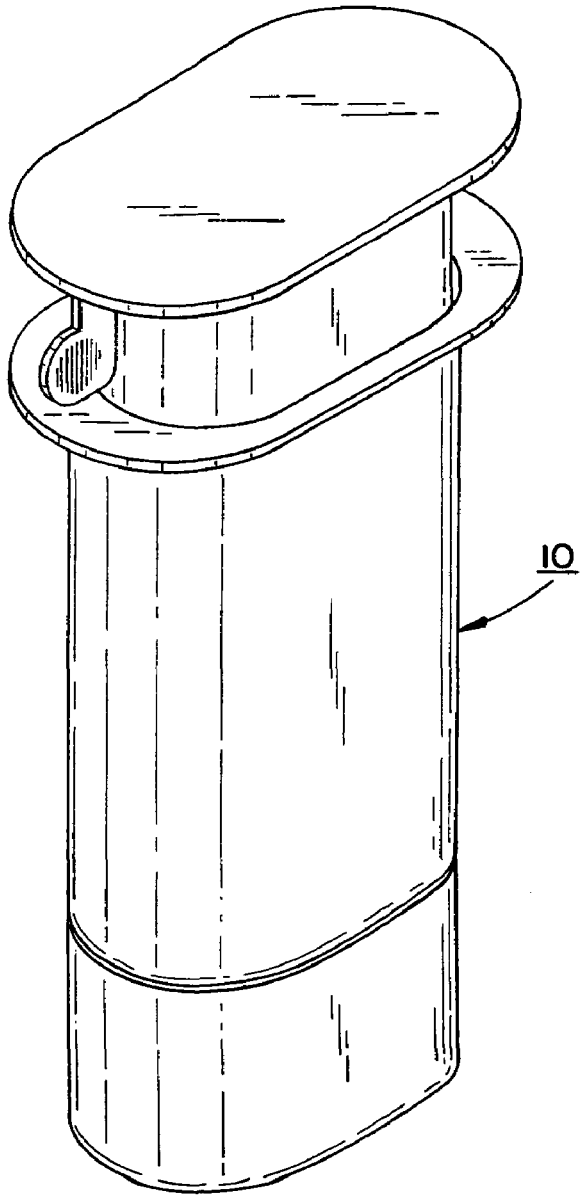

The foregoing is also illustrated on a larger scale in FIGS. 20 through 22 of the drawings, wherein the ring 42 is removed and the tamper evident tabs 44 are pulled off enabling the plate 30 to be depressed downwardly in a direction of arrows A. Thereupon as shown in FIG. 21 tips of the piercing elements 50 and 52 will puncture through ends 54 and 56 of the respective containers 24 and 26 enabling the contents thereof to enter into the region 90 within the receptacle 10 for eventual dispensing therefrom through the valve and the sponge 74, or other appropriate dispensing means.

With respect to that embodiment shown in operation in FIG. 22, after piercing the containers 24 and 26, the contents may be mixed by shaking the receptacle 10 and, after removing the cover 80, the admixed contents may by dispensed in a controlled manner as desired by applying pressure against the sponge 74 as shown in FIG. 22.

Figure 26:
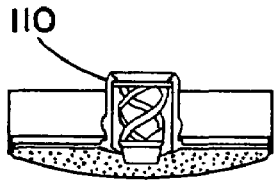
Figure 27:
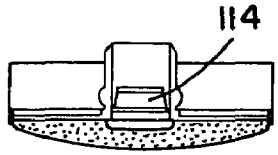
Figure 25:
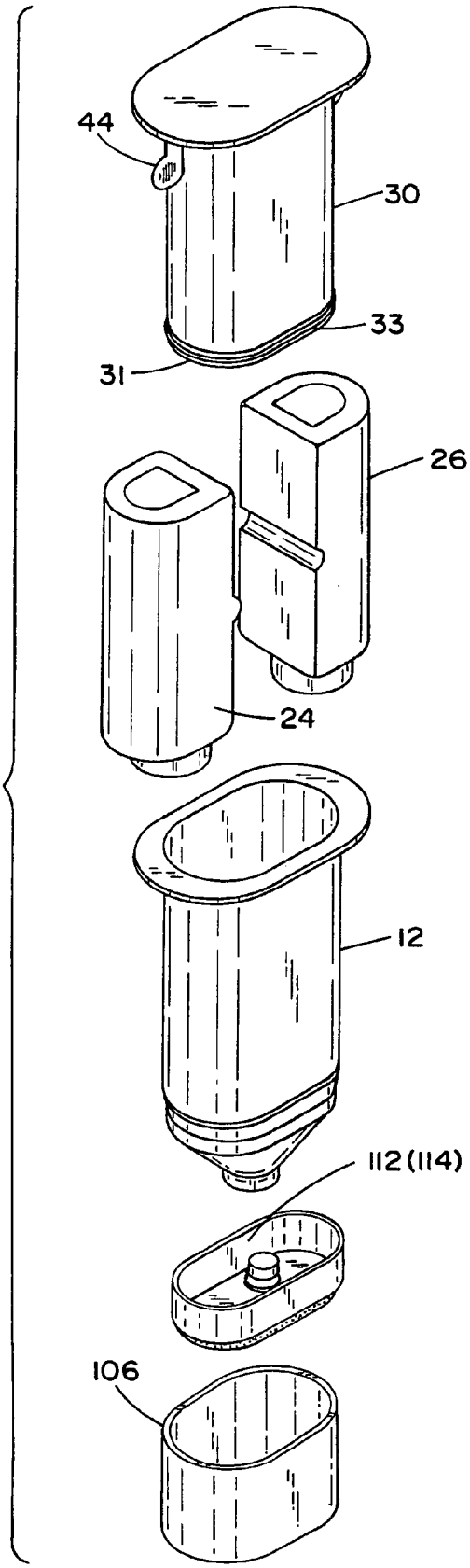

As shown in FIGS. 23 through 28, wherein like components with respect to previous described embodiments are identified by like reference numerals, the structure attached to the dispensing end of the housing 12 is a long bezel applicator having a bezel 100 with a sponge like applicator 102 having a protrubence 104 extending into the interior of the receptacle 10, a suitable valve 104 being provided therein. A dust cover 106 is adapted to cover the applicator portion. The valve 104 may be either a spring valve element 110 as shown in FIG. 26 or a squirt plug applicator valve 114 as shown in FIG. 27 such valve components being essentially illustrated in co-pending Provisional Patent Application Ser. Nos. 60/343,579, filed Oct. 22, 2001; and 60/348,149, filed Nov. 7, 2001, the disclosures of which are incorporated herein by reference. These valves may be interchangeable star-valves, cloverleaf valves and duckbill valves in elastomeric plugs, or spring-biased bucked valves, as described in these applications in detail. For the remainder of the embodiment shown in FIGS. 23–28, the construction and components are substantially identical to the preceding described embodiments in structure and operation.

From the foregoing it becomes readily apparent that the present invention describes a novel system and arrangements for mixing separate components or ingredients of a particular liquid lotion product prior to the dispensing thereof, while during storage such components are sealingly housed in separate sealed containers so as to preserve their life expectancy and properties over extended periods of time.

While the invention has been particularly shown and described with respect to preferred embodiments thereof, it will be understood by those skilled in the art that the foregoing and other changes in form and details may be made therein without departing from the spirit and scope of the invention.

What is claimed is:

1. A system for mixing two or more liquid components comprising:

a receptacle having a receiving end and a dispensing end, the receptacle being tubular and having one of an oblong or cylindrical cross-section and the receiving end of the receptacle further comprising a radially projecting flange;

at least two containers housed within the receptacle, each container containing a different liquid component;

a depressable member inserted into the receptacle at the receiving end;

piercing elements projecting from the dispensing end within the receptacle to penetrate each container and release the liquid component contained therein, whereby the two or more liquid components are mixed in the receptacle and dispensed through the dispensing end; and the at least two containers further comprise complementary recess and protuberance portions for maintaining the at least two containers in position relative to one another in the receptacle.

2. The system of claim 1, wherein the depressable member further comprises:

an end plate;

a sidewall extending from the end plate, the end plate and sidewall forming a closed end of the depressable member and the sidewalls extending therefrom forming an open end of the depressable member that complies with the cross-sectional shape of and extends into the receptacle;

a radially projecting flange at an outer perimeter of the end plate;

a ring enveloping the sidewall at the closed end of the depressable member; and breakaway tabs attached to the ring, the tabs precluding movement of the depressable member until the tabs are broken and removed therefrom the ring.

3. The system of claim 1, further comprising a nozzle threadedly secured to the dispensing end of the receptacle.

4. The system of claim 3, further comprising a tip separably secured to the nozzle such that separation of the tip from the nozzle permits the mixed liquid components to dispense through the nozzle.

5. The system of claim 1, further comprising an elongated neck at the dispensing end of the receptacle through which the mixed liquid components are dispensed, and a removable cap fitting over an open end of the elongated neck.

6. The system of claim 1, further comprising a valve fitted within the dispensing end of the receptacle and a sponge applicator through which the mixed liquid components are dispensed.

7. The system of claim 6, further comprising a cap fitting over the dispensing end of the receptacle and covering the valve and sponge applicator.

8. The system of claim 7, wherein the cap aligns with an outer surface of the receptacle.

9. The system of claim 1, wherein each container further comprises a frangible end through which the piercing elements penetrate to release the liquid component contained within the respective container.

10. The system of claim 9, wherein the liquid components are form the group consisting of liquids, lotions, gels, creams, or semi-liquid versions thereof.

11. The system of claim 1, wherein the dispensing end further comprises a bezel having a sponge applicator and valve provided therein.

12. The system of claim 11, further comprising a dust cover fitting over the sponge applicator.

13. The system of claim 11, wherein the valve is from the group consisting of a spring valve, a squirt plug valve, an interchangeable star valve, an interchangeable cloverleaf valve, and an interchangeable duckbill valve.

14. A method of dispensing a mixture of two or more liquid components from a common receptacle, the method comprising:

providing at least two containers containing different liquid components;

housing the at least two containers within a common receptacle, the receptacle having a receiving end through which the containers are received and a dispensing end through which the liquid components are dispensed;

providing a depressible member within the receptacle, the depressible member having an endplate adjacent the at least two containers;

providing piercing elements projecting from the dispensing end within the receptacle towards the at least two containers;

pushing the depressible member against the at least two containers to move the containers towards the piercing elements whereby the piercing elements penetrate the containers causing the liquid components contained therein to release into the common receptacle;

dispensing the mixed liquid components through the dispensing end;

providing a nozzle at the dispensing end through which the mixed liquid components are dispensed;

providing a valve fitted within the dispensing end and a sponge applicator over the valve through which the mixed liquid components are dispensed; and providing breakaway tabs on the depressible member that preclude movement of the depressible member and mixing and dispensing of the liquid components until the tabs are broken and removed from the depressible member.

15. The method of claim 14, wherein the liquid components are from the group consisting of liquids, lotions, gels, creams, or semi-liquid versions thereof.

* * * * *